US007735428B2

(12) United States Patent
Petty

(10) Patent No.: US 7,735,428 B2
(45) Date of Patent: Jun. 15, 2010

(54) CONCEALABLE TABLE

(75) Inventor: Michael Carl Petty, Bivins, TX (US)

(73) Assignees: Suzanne Dupree, Avinger, TX (US); Michael Carl Petty, Bivins, TX (US)

( * ) Notice: Subject to any disclaimer, the term of this patent is extended or adjusted under 35 U.S.C. 154(b) by 405 days.

(21) Appl. No.: 11/943,838

(22) Filed: Nov. 21, 2007

(65) Prior Publication Data

US 2009/0126605 A1 May 21, 2009

(51) Int. Cl.
*A47B 3/00* (2006.01)

(52) U.S. Cl. ..... 108/40; 108/38; 312/245

(58) Field of Classification Search ..... 312/242, 312/245, 313, 315, 316, 325; 108/38, 40, 108/42, 33, 134
See application file for complete search history.

(56) References Cited

U.S. PATENT DOCUMENTS

| | | | | | |
|---|---|---|---|---|---|
| 1,210,415 | A | * | 1/1917 | Campbell | 108/33 |
| 1,502,152 | A | | 7/1924 | Millett | |
| 1,610,955 | A | * | 12/1926 | Lannom | 297/14 |
| 1,610,956 | A | * | 12/1926 | Lannom | 108/33 |
| 1,700,545 | A | | 1/1929 | Sanders | |
| 1,741,094 | A | | 12/1929 | Chandler | |
| 1,753,423 | A | | 4/1930 | Kroschel | |
| 1,765,343 | A | * | 6/1930 | Madsen | 108/38 |
| 1,766,154 | A | * | 6/1930 | Triller | 108/40 |
| 1,795,636 | A | * | 3/1931 | Chandler | 108/40 |
| 1,796,569 | A | * | 3/1931 | Madsen | 108/39 |
| 1,802,291 | A | * | 4/1931 | Triller | 108/40 |
| 1,805,737 | A | | 5/1931 | Laursen | |
| 1,838,846 | A | | 12/1931 | Laursen | |
| 2,549,723 | A | | 4/1951 | Thatcher | |
| 2,567,538 | A | | 9/1951 | Anderson | |
| 2,650,146 | A | * | 8/1953 | Mugler | 108/38 |
| 2,760,836 | A | | 8/1956 | Fangman | |
| 2,963,078 | A | | 12/1960 | Ferrelle | |
| 3,696,762 | A | | 10/1972 | Holdham | |
| 4,136,622 | A | * | 1/1979 | Bue et al. | 108/48 |
| 4,862,611 | A | | 9/1989 | Wright | |
| 4,899,667 | A | | 2/1990 | Miller et al. | |
| 5,040,468 | A | | 8/1991 | Miller et al. | |
| 5,460,101 | A | | 10/1995 | Garbutt | |

FOREIGN PATENT DOCUMENTS

| | | | | |
|---|---|---|---|---|
| FR | 2630312 | | 10/1989 | |
| WO | 9111130 | * | 8/1991 | 108/134 |

* cited by examiner

*Primary Examiner*—Hanh V Tran
(74) *Attorney, Agent, or Firm*—Eugenia S. Hansen; Hemingway & Hansen, LLP

(57) ABSTRACT

A table assembly which permits a table top to have a first use position and a second stored position is disclosed. In the first position the table top may serve as a conference table, desk, dining table or the like and in the second position be positioned essentially parallel with an upright wall of a room in which it is installed. The storage unit may also be a furniture piece comprising a variety of optional features. In one embodiment, a storage unit furniture piece comprises a deeper cabinet structure that may be fitted with, for example shelves for books and the like or a bar for hanging clothing. Generally, the table assembly is secured to a wall of a room or installed between the studs which frame the wall of a room. The table assembly may have its own upright wall.

20 Claims, 12 Drawing Sheets

CONCEALABLE TABLE

CROSS REFERENCE TO RELATED APPLICATIONS

Not Applicable

STATEMENT REGARDING FEDERALLY SPONSORED RESEARCH OR DEVELOPMENT

Not applicable.

TECHNICAL FIELD

This invention relates to the field of tables attached to a wall or other upright structure which have a table top which in stored position is essentially parallel to a wall and a use position in which the table top is essentially perpendicular thereto.

DETAILED DESCRIPTION

Figure 1:
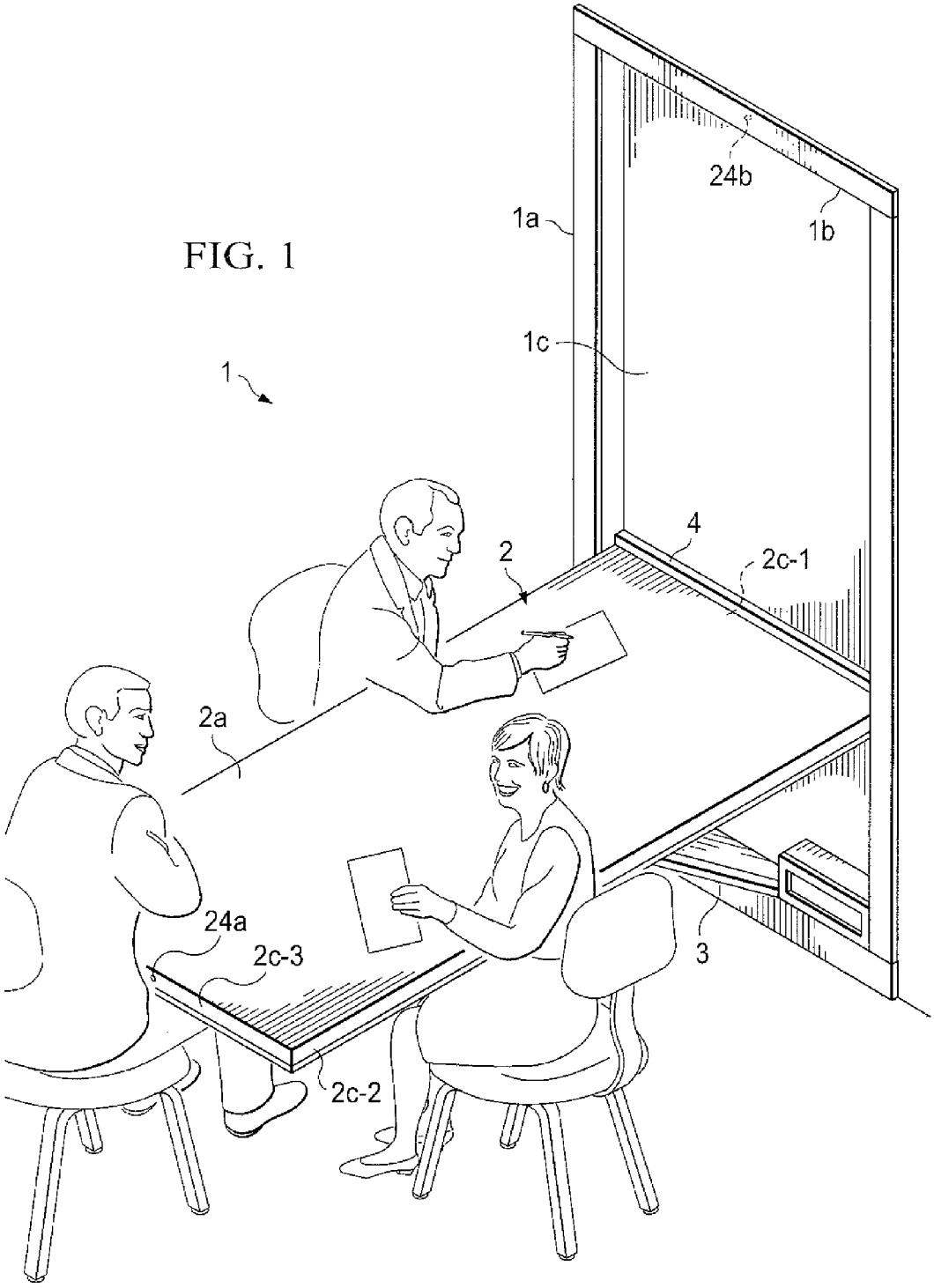
FIG. 1 is an environmental view of one embodiment of the present invention showing users employing a table top in use position

A table assembly which permits a table top to have a first use position and a second stored position is disclosed. In the first position the table top may serve as a conference table, desk, dining table or the like and in the second stored position be positioned essentially parallel with an upright wall. The upright wall may be a wall of a room or the upwardly extending portion of a storage unit adapted to receive said table assembly. The storage unit may be only a few inches deep, such as the area defined by structural two by fours commonly used for framing interior walls of rooms, or it may be deeper. The storage unit may also be a furniture piece comprising a variety of optional features. In one embodiment, a storage unit furniture piece comprises a deeper cabinet structure that may be fitted with, for example shelves for books and the like or a bar for hanging clothing. The upright wall does not form a part of the table assembly but may form a part of a furniture piece comprising a table assembly. Generally, the table assembly and/or storage unit is secured to an upright wall of a room or installed between the studs which frame the wall of a room.

The table assembly comprises a unit support casing which is a generally rectangular structure forming the outer dimensions of the assembly. It is generally made of four lengths of strong wood secured together to form a rectangular assembly large enough to surround a table top of the desired dimensions when the table top is in a stored position. In another embodiment, the unit support casing is integral to a furniture piece which may be affixed to a structure. The unit support casing comprises four inner casing surfaces, including a top inner casing surface, two side inner casing surfaces and a bottom inner casing surface.

The table assembly further comprises a table top which serves as the desired horizontal surface in the use position. the table top having a generally rectangular outline, comprising at a table top surface and a table bottom surface, each of which have an outwardly facing side and an inwardly facing side, and four side surfaces each each of which have an outwardly facing side and an inwardly facing side, said side surfaces connecting the table top surface to the table bottom surface, said table top having a first use position and a second stored position in said assembly;

The outwardly facing table top surface faces the ceiling of the room in a use position and the outwardly facing table bottom surface faces the floor of the room in the use position. The four side surfaces may be integral to a table top made in a single piece or can be separate components attached to the table top and table bottom surface respectively.

The table top can be fashioned from many types of materials to provide an aesthetically pleasing or utilitarian surface in the use position. For example, the table top can be made out of fine woods, metal, laminate and the like. The table top surface and the table bottom surface can be made of the same or different materials. In some embodiments, the bottom surface will desirably be covered with a fabric, wallpaper, or other material which will permit it to either blend into or aesthetically complement the decor of the room. It is most preferred that the bottom surface of the table comprise an attractive material since when the table assembly is in the stored position, at least a portion of the bottom surface of the table top will be visible as a surface parallel to the upwardly extending wall of a room. In an alternate embodiment, the portion of the table bottom surface which will be so visible is only approximately the top half to top third. Therefore, if is desired that rare or expensive wood laminates or other coverings are visible when the table assembly is in stored position, the portion of the bottom surface of the table top which will not be visible need not be provided with the same material as the visible portion. The invention permits use of a large table top from about 60 to about 80 inches long, preferably from about 65 to about 75 inches long, and most preferably about 70 inches long. Most preferably, the table top is from about 25 to about 45 inches wide, preferably from 25 to 35 inches wide, and most preferably about 30 inches wide.

In the stored position, the four side surfaces of the table top lie adjacent the four inner casing surfaces of the unit support casing which surfaces together form a recessed area adapted to receive said table top in said second stored position.

The table assembly further comprises a framework which serves as a skeletal support for the table top and as a housing for a latching assembly. In a preferred embodiment, a table top supported by said framework comprises four edges. A first and second edge of the four edges each have one end proximal to and one end distal from the unit support casing in use position. A fourth edge of the four edges is discontinuous and comprises a first fourth edge portion and a second fourth edge portion, which each have a side and inner end and are each adjacent and parallel to the upright wall in use. The side end of the first fourth edge portion is connected to the proximal end of the first edge and the side edge of the second fourth edge portion is connected to the proximal end of the second edge. A third edge distal from the upright wall connects the distal ends of the first and second edges. The inner ends of the first and second fourth edge portions are connected to an inner support beam as will be detailed below.

The framework preferably comprises square metal tubing which continuously defines the first, second and third edges of the rectangular table top. The fourth edge is discontinuous and each of the edge portions is defined by the square metal tubing. Side frame portions extending downwardly from said first and second long edges are opposite and parallel to one another and have an inner surface and an inward end and an outward end. An end frame portion extends downwardly from the third edge and said end frame is attached to each of the two parallel side frame portions near their outward end. The end frame portion is perpendicular to the two parallel side frame portions. A proximal frame portion extends downwardly from said fourth edges and is attached to said side frame portions near the inward ends. The frame can be made of round metal tubing, in which case the entire circumference serves as the edges and the side frame portions, but is otherwise connected to the first, second, third and fourth edges in the same way as the square metal tubing. Other materials can be used for the frame other than metal as long as they are sufficiently strong to support the materials selected for the table top and the connecting hardware.

The framework preferably further comprises a first inner support beam secured to each of the two side frame portions. In a preferred embodiment, a first inner support beam is attached to the inner surface of each side frame portion in the general area of the midpoint of the length of the side frame portion.

The framework further comprises a second inner support beam perpendicular to the first inner support beam and attached thereto, essentially at the midpoint thereof. The second inner support beam is also attached to the inner surface of the third end frame portion. The second inner support beam preferably defines a hollow interior adapted to encase a latching mechanism. Alternatively, the second inner support beam may be solid and the latching mechanism secured to the outer surface thereof.

Third and fourth inner support beams which are parallel to the side edges connect to the first inner support beam and the fourth edge portions.

Figure 2A:
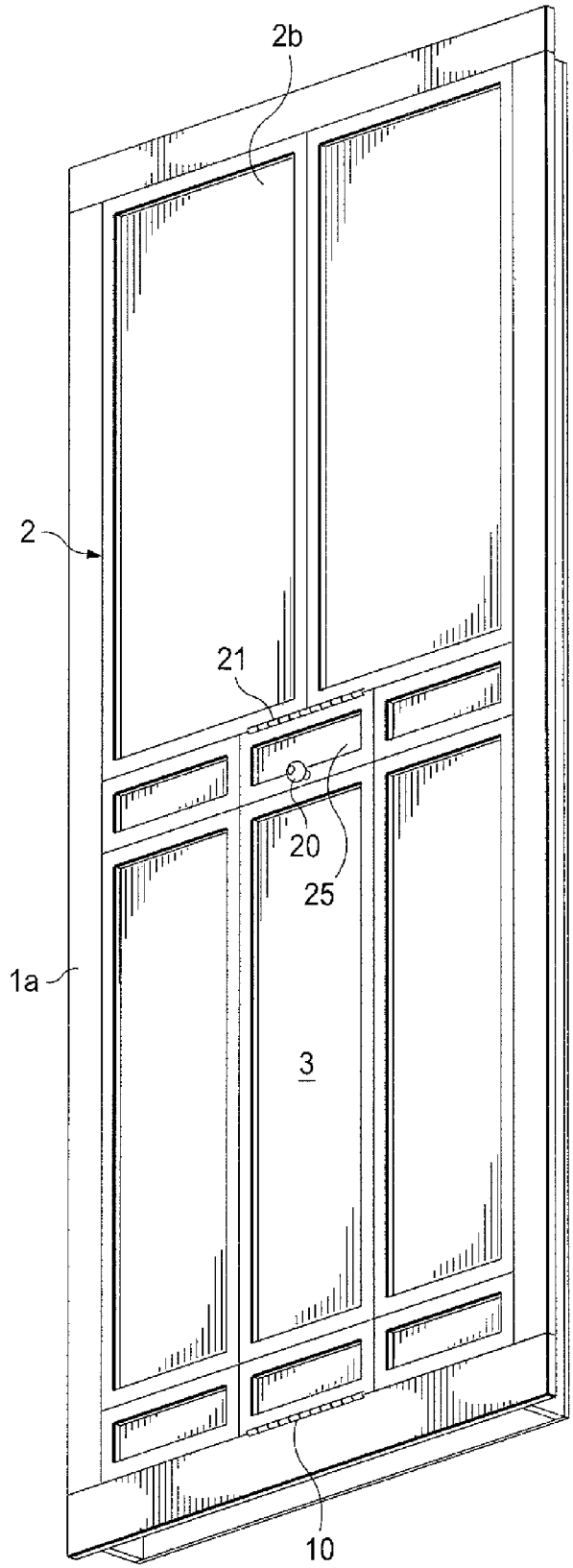
FIG. 2A is a perspective view of the invention according to FIG. 1 with the table assembly in its closed or stored state.
Figure 6:
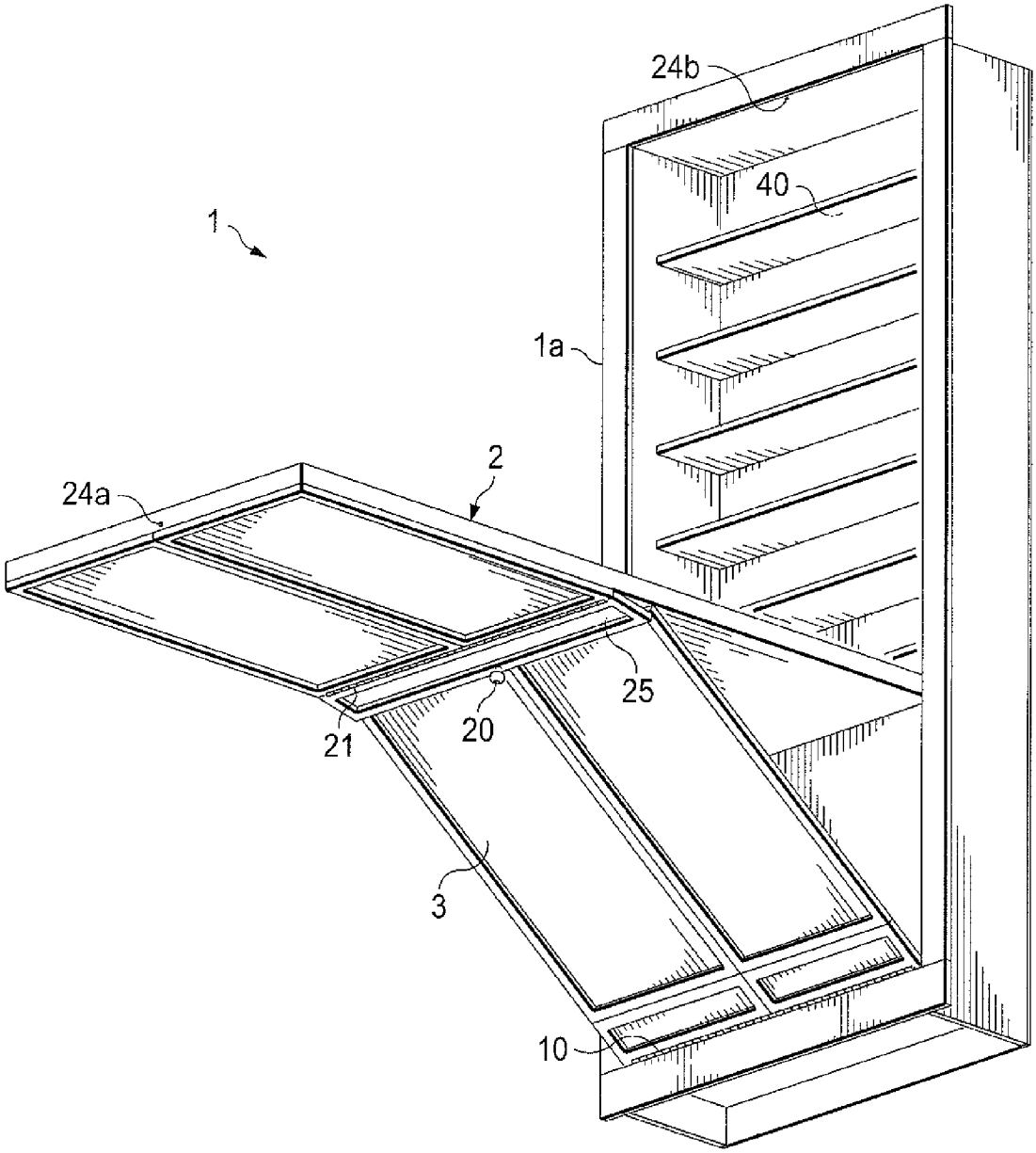
FIG. 6 is a perspective view of an alternative embodiment of the invention.

The framework further comprises a support leg structure having a top edge and a bottom edge. The support leg top edge is pivotably secured to the third and fourth inner support beams by pivotable fasteners. In the preferred embodiment grade 8 hardened bolts machined into pins form a pivotable fastener which allows for pivotal movement of the frame of the table top from 90 degrees (vertical during storage) radially outwardly to 45 degrees (essentially parallel to the ground during use). The pivotable fastening means are preferably provided with spacers comprising Teflon material or the like to ensure a strong joint and still allow movement. The pivotable fastening means function to permit constrained relative rotational motion between the support leg and the unit casing. Preferably, the device is a bearing or a hinge. Most preferably, a heavy-duty supporting hinge is used. Examples of hinge types useful in the invention are: baldwin hinges, plain bearing hinges, or ball bearing hinges. Preferably a hinge which is approximately the length of the supporting leg structure as best seen in FIG. 2A and FIG. 6 (Item 10) is utilized. However, in the embodiment shown in FIG. 6, shorter hinges can be alternatively used but it may be advisable to employ more than one hinge. For example, two hinges may be used each attached about ¼ length inward from the edge. The supporting hinge preferably allows the supporting leg structure to rotate outwardly from an upright wall which is at approximately 90 degrees (vertical during table top storage) to about from 67.5 to about 45 degrees (angled during use position). The support leg is preferably covered on at least the side which will appear contiguous with the table top back during storage to match or complement said table top back.

Figure 3A:
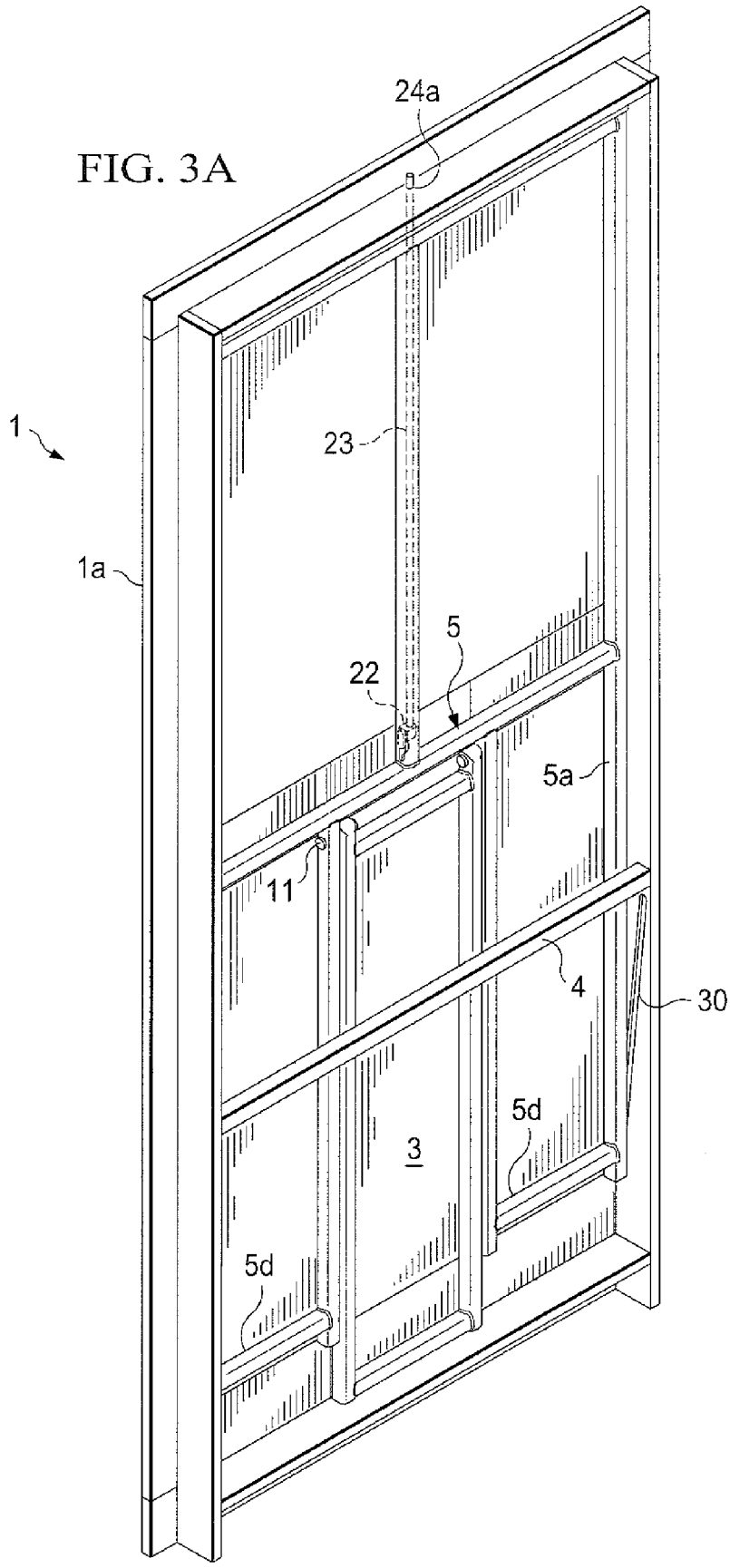
FIG. 3A is a perspective view of the underside of the table top according to FIG. 1 with the table assembly in its closed state from the point of reference of the wall looking outwardly, but removed from the wall, to allow viewing of the framework.

A latching system is incorporated into the frame which comprises a rod having an engagement end and an inner end. The engagement end of the rod is engagable with an aperture defined by the material of the inner top portion of the table assembly. The engagement end inserts into the aperture when the table assembly is in stored position. The engagement end is released from the aperture by moving the rod vertically downwardly. The rod is attached to a latch which has a first position as best seen in FIG. 4B wherein 22 has been activated by the use of the latch panel and a second position as best seen in FIG. 3A wherein 23 extends into 24A. The latch can be moved to the second position by pulling up on a latch panel accessible from the table top bottom which faces outwardly into the room in which the table assembly is installed during storage of the table top. The latch panel is located toward the center of the table top bottom side. Preferably, the latch panel will be pulled up and this causes the latch to pull downward on the rod. The rod is preferably concealed in the second inner support beam, but can be installed to run alongside of it as well. When table assembly is in its stored state, this rod typically extends through the third edge of the table into an aperture defined by surrounding material within the unit casing to lock the table top in place. When the rod is pulled downward, it is retracted inwardly into or past the third edge of the table, releasing the table from its locked state.

Two roller guide slots are most preferably provided in the side inside of the unit casing. These roller guide slots can be either carved into the wood of the table assembly or provided in a separate attached piece. The roller guide slots preferably are positioned so that they begin at the bottom near an outer edge of the side unit casing and run upwardly at a diagonal toward the inner edge of the side unit casing. Rollers connected to the table top's first and second side edges, near the fourth edge, engage with the roller guide slots and assist in moving the table top from the stored position to the use position. The rollers make the table more stable in use.

When in the upright position with the table top stored within, the table assembly comprises an outer facade adapted to be visible to persons in the interior of a room in which the table assembly is installed. In a preferred embodiment, the outer facade comprises the bottom surface of the table top which further comprises the supporting leg structure. In this embodiment, the outer facade comprises an upper portion consisting of the bottom surface of the table top and a lower portion comprising the outer surface of the support leg and two additional panels which remain adjacent to the bottom surface of the table top at all times as illustrated in FIG. 2A. The upper portion should be somewhat shorter than the bottom portion in length so as to allow table top to be level when in its final position. The preferred ratio of upper portion length to bottom portion length is 56%.

In an alternative embodiment, such as exemplified in FIG. 7, the outer facade comprises an upper portion which is the bottom surface of the table top and a lower portion which is separate from the table top and overlays the bottom portion of the bottom of the table top.

The outer facade further comprises a latch panel. The latch panel appears to be part of the outer facade, but may be pulled up thereby initiating release of the latching rod. The release of the latching rod permits the table top to be moved to the use position.

An assisting trim may be placed at the back of the unit casing or side panel area as a support to help prevent over rotation of table assembly and to help with leveling the table top.

The outer facade of the table assembly is adaptable to resemble a cabinet or door, to blend in with the wall to which it is attached, or any other desired ornamental feature. Most preferably, the outer facade appears to be a door of a large armoire or cabinet. Depending on the desired embodiment, different cabinet designs or options are available.

Different embodiments of the invention allow for certain advantages and disadvantages. For example, the preferred embodiment has a supporting leg structure dimensioned to permit people to sit at the end of the table top nearest the wall and still have adequate leg room. In an alternative embodiment which comprises a supporting leg structure as wide as the table top, the supporting leg structure has arguably more strength to support a heavier table top, but the leg room is compromised. The selection of the supporting leg structure also affects available aesthetic choices for the lower portion of the outer facade. The alternative embodiment provides for the greatest range of choices since it does not have a portion of the facade which separates from the bottom of the table top.

The following Figures are provided to better illustrate the preferred embodiments of the invention.

Figure 2B:
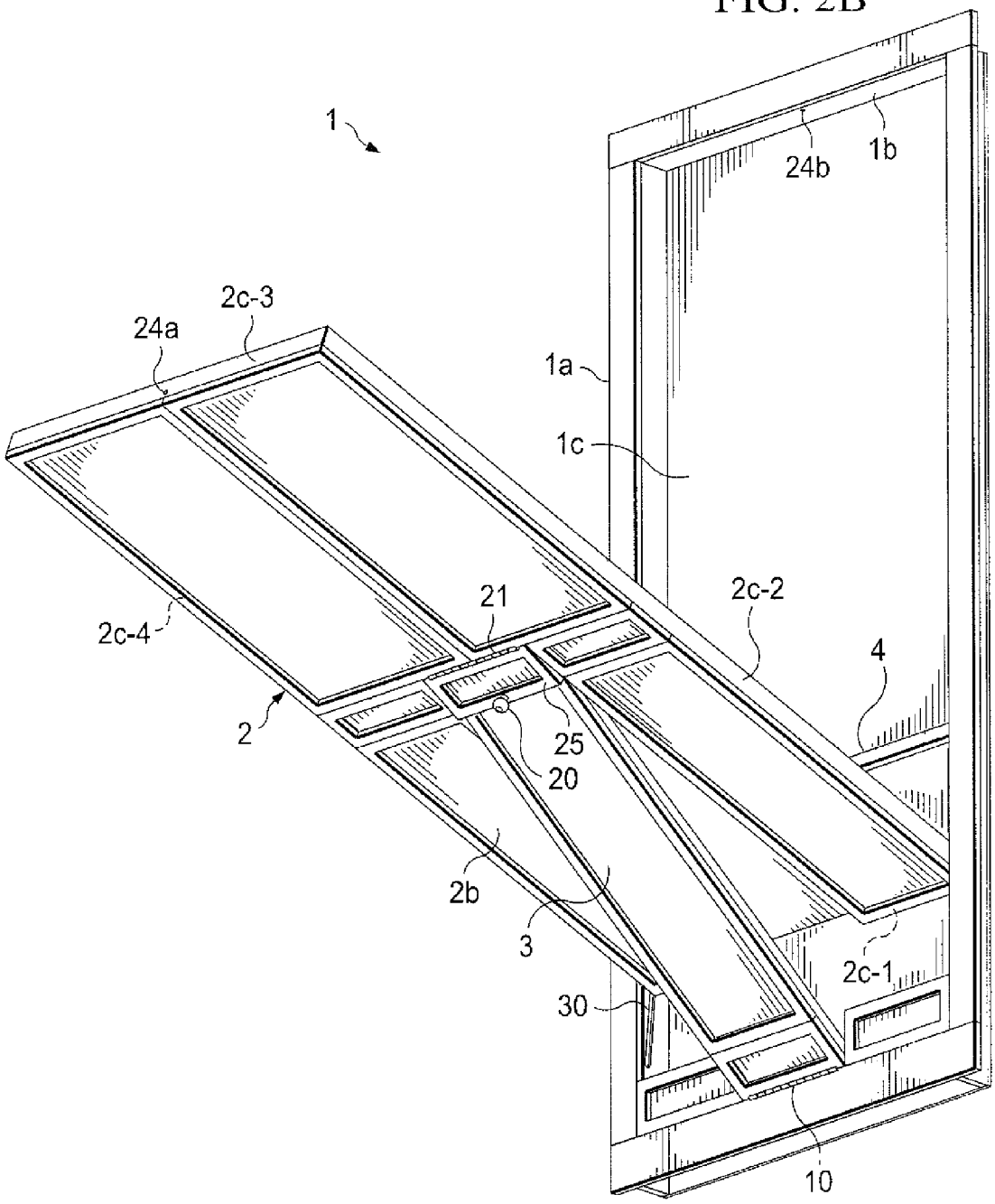
FIG. 2B is a perspective view of the invention according to FIG. 1 illustrating the table assembly in transition from stored to open position

FIG. 1 shows an environmental view of the preferred embodiment of the table assembly (1) invention in its first use position. Table assembly (1) comprises unit support casing (1*a*), table top (2) and supporting leg structure (3). With table top (2) in its first use position (fully deployed), supporting leg structure (3) has been moved outwardly from the upright wall (1*c*) to its support position where it supports the weight of the table top. Details of the motion of supporting leg structure (3) is best illustrated in FIG. 2B discussed below. Upright wall (1*c*) in one embodiment may form a portion of table assembly (1) and in another embodiment may be a separate structure such as, for example, a wall of a room. When upright wall (1*c*) is a part of the room structure rather than the table assembly, it may be, for example, wall board that typically forms the interior surface of a room, or the upright interior wall under wood or metal studs which typically are employed in interior construction of a wall. Table top assembly (1) can be dimensioned to be installed between such studs and secured thereto. In such case, table top assembly (1) will appear to be a built-in cabinet door or full size door when viewed in stored position from the room.

Still referring to FIG. 1, assisting trim (4) is affixed to either unit support casing (1*a*) or to upright wall (1*c*) and serves to position table top (2) at a fixed, level position. When table top (2) is moved to its first use position from its second stored position, assisting trim (4) stops further movement once the desired location is reached. Table top (2) comprises a table top surface (2*a*), a table bottom surface (2*b*) (not visible in FIG. 1) and four side surfaces (2*c*-1, 2*c*-2, 2*c*-3, and 2*c*-4). Side surface (2*c*-1) lies adjacent upright wall (1*c*) in FIG. 1 just under assisting trim (4) when table top (2) is in the first use position. As users put weight on the table top during utilization, the assisting trim prevents upward movement of the portion of table top (2) nearest side surface (2*c*-1).

Aperture 24*a* is visible in FIG. 1 on table top side surface (2*c*-3) which is the side most distal from upright wall (1*c*) when table top (2) is in the first use position. The purpose for 24*a* is best illustrated in FIG. 3A, and will be discussed below.

FIG. 2A illustrates a perspective view of the preferred embodiment of the invention in its second stored position (closed state), but not installed so that the relative depth of table assembly (1) can be appreciated. Unit support casing (1*a*) defines the outer dimensions of table assembly (1). Supporting hinge (10) hingeably attaches supporting leg structure (3) to unit support casing (1*a*).

The outer facade (the portion which will be visible to viewers when installed in a room) of table top assembly (1) is illustrated in FIG. 2A as a wooden cabinet front. Many versatile, attractive outer facades can be envisioned for table assembly (1). Alternately, the outer facade can be made to match the decor of the wall on which it is installed so that it blends in with the wall.

Pull (20) is secured to latch panel (25) which is attached via pull hinge (21) to table top bottom surface (2*b*). While latch panel (25) appears to be a drawer or door to a compartment, it serves as the means to initiate unlatching of table top (2) from unit support casing (1*a*). When pull (20) is pulled by a user, hinge 21 rotates latch panel (25) upwardly. This motion activates a latching mechanism which is best seen in the following several figures.

FIG. 2B shows the preferred embodiment of the invention in a partially deployed state from a perspective view from an angle below the plane of the table top (2), and it can be seen that a portion of the outer facade serves as table top bottom (2*b*). In this partially deployed state, the table top has moved from a second stored position in which it was perpendicular to the ground toward the first use position. As it is so moved, side surface (2*c*-1) which is the side of table top (2) closest to the ground when it is in said second stored position, slides upwardly to a final destination about 45° from ground, just beneath assisting trim (4). As the table top (2) moves towards its first use position, the supporting leg structure (3) separates from the outer facade so as to provide support for the table top (2).

One of a pair of roller guide slots (30) which are provided in unit casing (1*a*) in the preferred embodiment is partially visible in FIG. 2B. Not visible are rollers (31) which are secured to table top side surfaces 2*c*-2 and 2*c*-4. The rollers assist in moving the table top between the second stored position and the first use position. The structure and detail of the roller guide slots (30) and rollers (31) is best seen in FIGS. 3B and 5A-5C and will be discussed in more detail below.

FIG. 2B illustrates latch panel (25) in a position indicating rotational outward movement about pull hinge (21). This movement has caused the latching rod (23, not visible), to retract into table top (2) through aperture (24*a*) on table top side (2*c*-3). When table top assembly (1) is in the second stored position illustrated in FIG. 2A, a rod extends through aperture (24*a*) and into aperture (24*b*) defined by inner top portion (1B) of unit support casing (1A), which is visible in FIG. 2B.

Figure 2C:
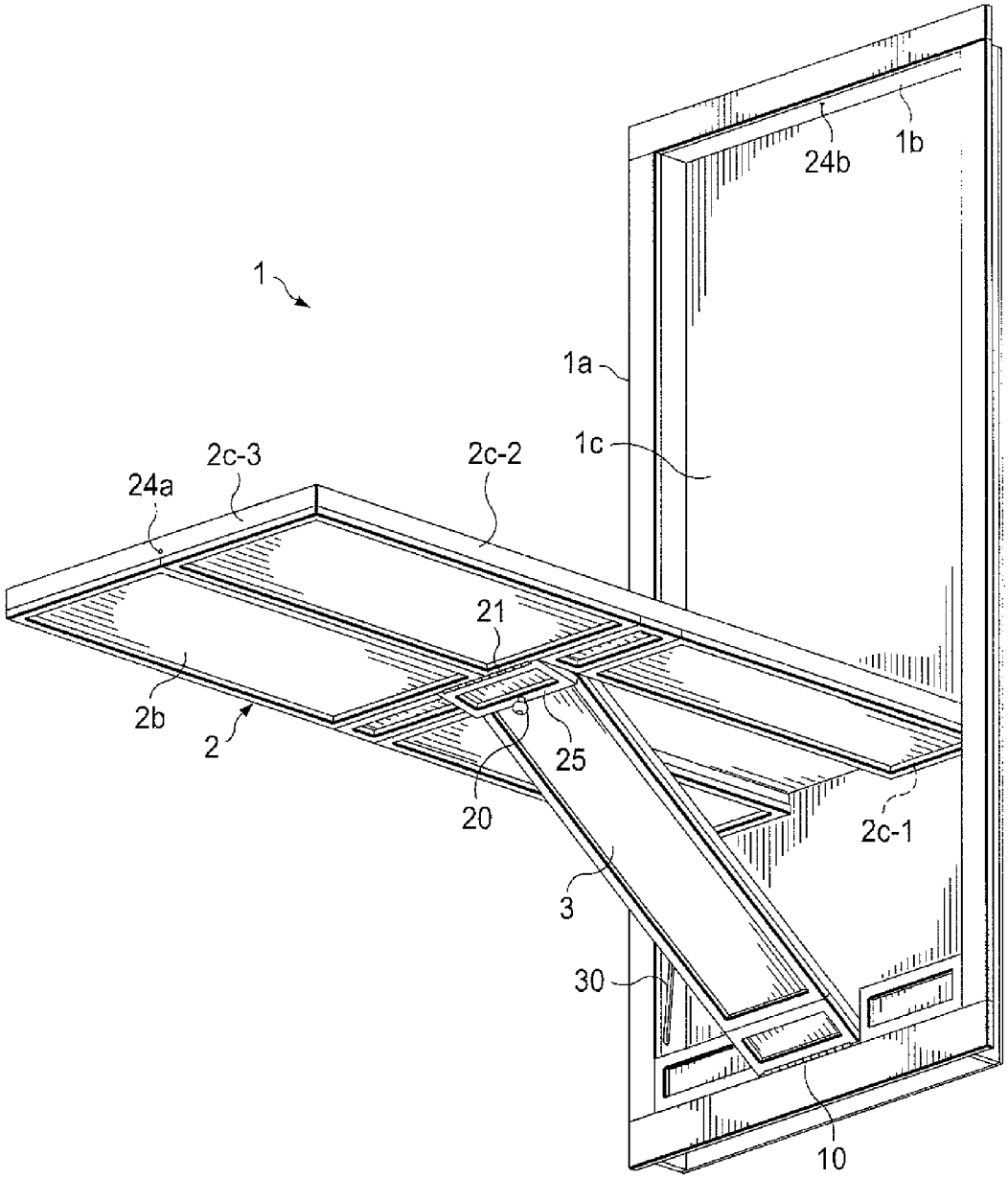
FIG. 2C is a perspective view of the invention according to FIG. 1 with the table assembly in its fully open state where it is in use position available for use as a table.

FIG. 2C illustrates the preferred embodiment of the invention in its first use position (fully deployed) from an angle below the plane of the table top (2). In this state, table top (2)

is perpendicular to unit support casing (1*a*). Not visible is assisting trim (4) which is just above table top proximal end (2*c*-1).

FIG. 3A illustrates the preferred embodiment of the invention in an uninstalled closed state as seen from behind the embodiment with any upright wall (1C) employed removed. The latching mechanism (22) is in its resting state, and latching rod (23) extends through aperture (24*a*) in table top side (2*c*-3). Pivotable fasteners (11) are visible in this view, and they serve to attach supporting leg structure (3) to framework (5). The motion of supporting leg structure (3) as illustrated in FIGS. 2B and 2C is enabled by Pivotable fasteners (11).

In this embodiment, assisting trim (4) is attached to unit support casing (1*a*). In an alternate embodiment, assisting trim (4) can be attached to upright wall (1*c*), which may or may not be a part of the table assembly (1). It is most preferred that assisting trim (4) be attached to unit support casing (1A) so that table assembly (1) can be supplied as a complete unit for installation.

Portions of framework (5) are illustrated in FIG. 3A as they would lie when table assembly (1) is in the second stored position. One of the pair of roller guide slots (30) is also visible. Framework (5) preferably has an attached roller near proximal frame portions (Ed) but attached to the outer edge of side frame portions 5*a* and 5*b*.

Figure 3B:
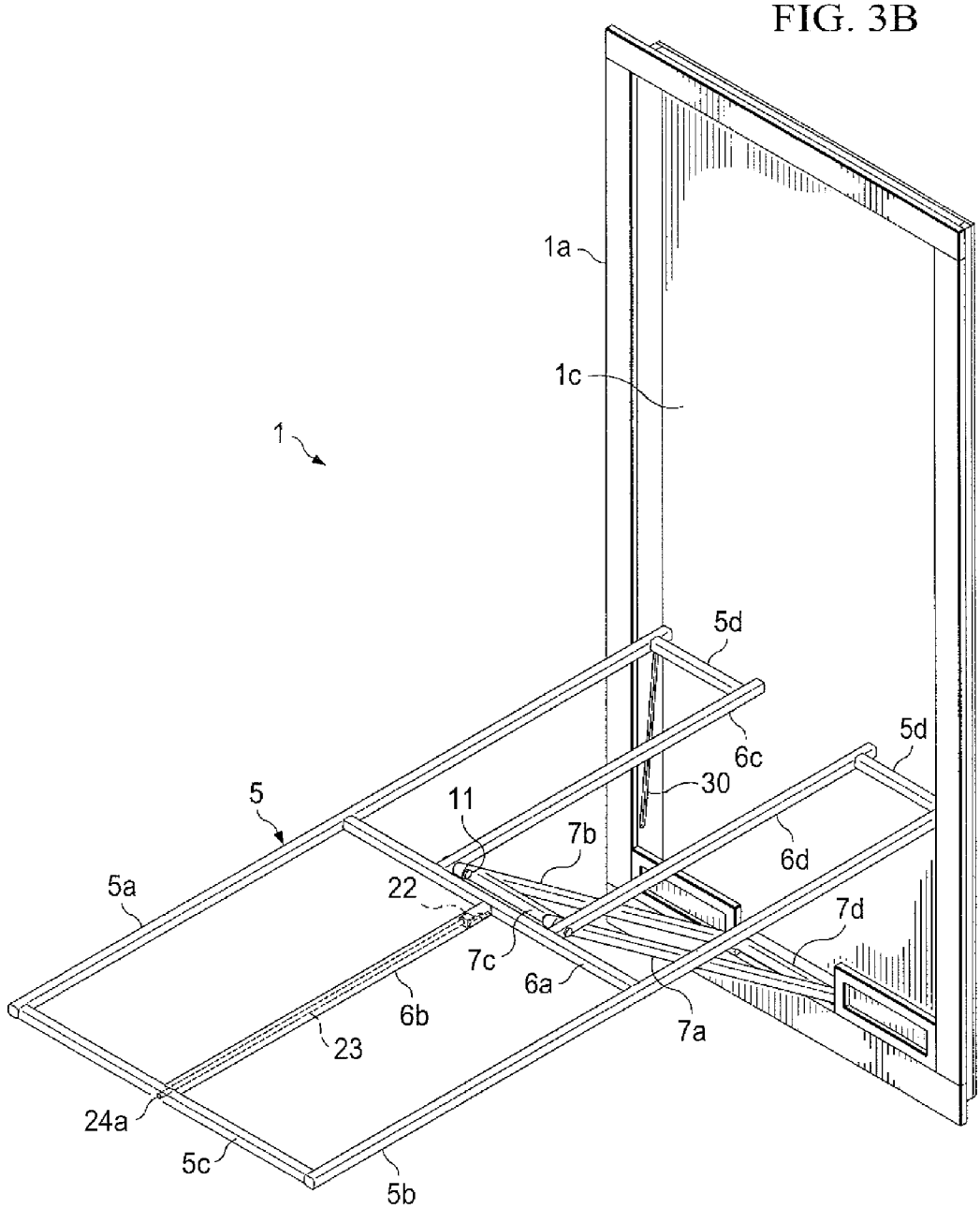
FIG. 3B is a perspective view of the invention according to FIG. 1 in its fully open state with material comprising the table top removed to allow viewing of framework.

FIG. 3B shows the preferred embodiment of the invention in its first use position (fully opened) with the table top removed so that the mechanism can be more fully illustrated. Supporting framework (5) includes first and second side frame portions (5*a*) and (5*b*), end frame portion (5*c*) connected to each of side frame portions (5*a*) and (5*b*) and two proximal frame portions (5*d*), one of which is connected to side frame portion (5*a*) and the other to side frame portion (5*b*). The framework further comprises first inner support beam (6*a*), second inner support beam (6*b*), third inner support beam (6*c*), and fourth inner support beam (6*d*).

First inner support beam (6*a*) is attached to each of side frame portions (5*a*) and (5*b*) as well as to (6*c*), (6*d*) and (6*b*).

Second inner support beam (6*b*) is attached to end frame portion (5*c*) and to (6*a*).

Third and fourth inner support beams (6*c*) and (6*d*) are each attached to (6*a*), while (6*c*) is attached to one of proximal frame portions (5*d*) and (6*d*) is attached to the other of proximal frame portions (5*d*).

Pivotable fasteners (11) are visible and supporting leg structure (3) has been moved from the pivot points provided by these fasteners to its support position as seen in FIG. 3B. Supporting leg structure (3) also has an inner structural support frame (7) with side components (7*a*) and (7*b*) cross bar (7*c*) and lower bar (7*d*). Pivotable fasteners (11) are secured to each of (7*a*) and (7*b*) just above the connection of cross bar (7*c*) to (7*a*) and (7*b*).

Aperture (24*a*) in end frame portion (5*c*) is visible. Aperture (24*a*) will extend through the table top material as seen in FIG. 1. Latching rod (23) is illustrated with phantom lines as it retracts into second inner support beam (6*b*).

Still referring to FIG. 3B, proximal frame portions (5*d*) now are positioned adjacent upright wall (1*c*). One of roller guide slots (30) is visible and the path that table top (2) has taken along these slots can be visualized.

Figure 4A:
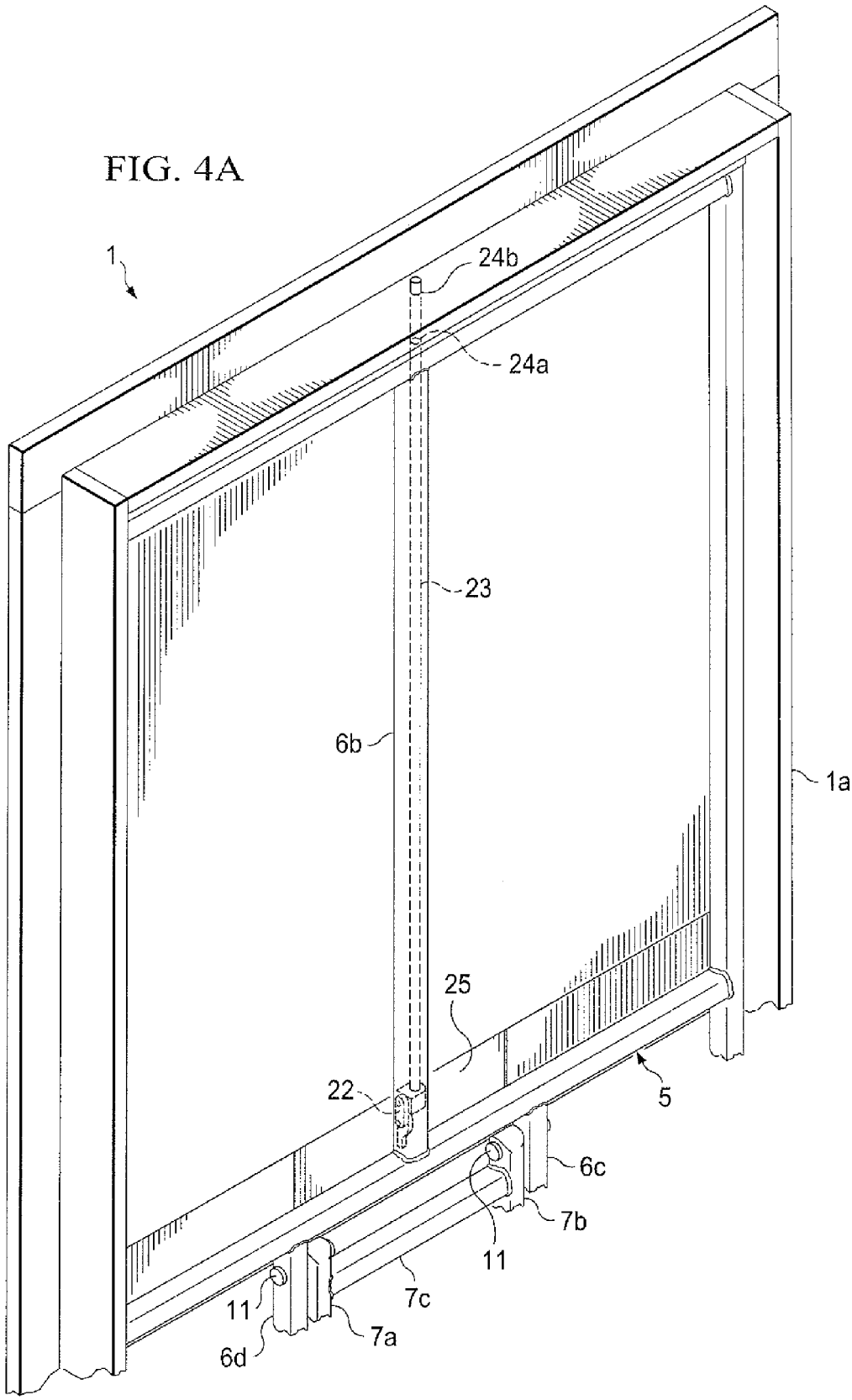
FIG. 4A is a perspective view of the latching system found within the framework in its latched state.
Figure 4B:
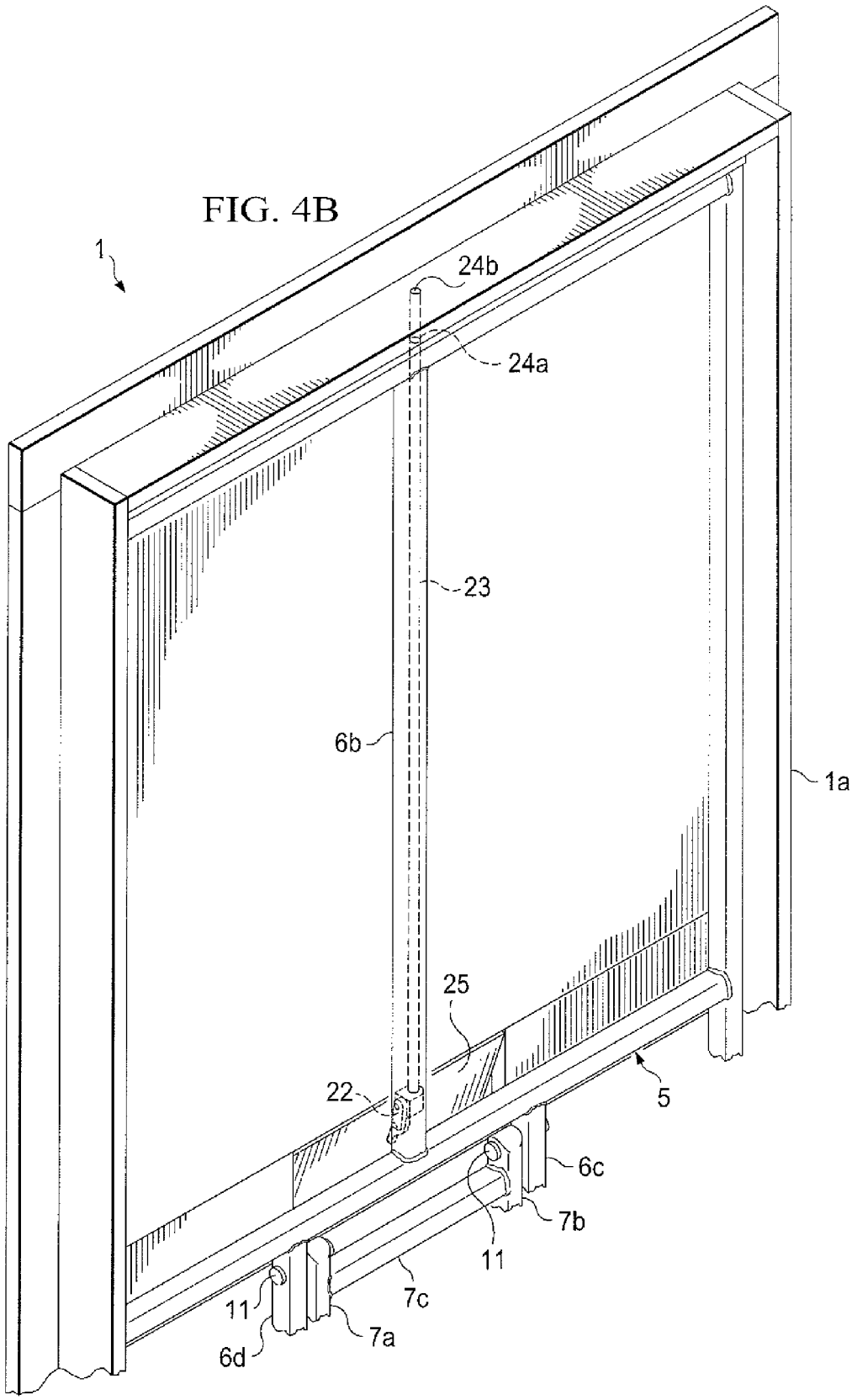
FIG. 4B is a perspective view of the latching system found within the framework in its unlatched state.

FIG. 4A shows the upper half of the preferred embodiment of the invention (uninstalled) with the table top in a second stored position with any upright wall (1*c*) removed and the latching mechanism (22) in rest position. In this detailed look at the latching mechanism, latching rod (23) is illustrated in phantom lines inside the second inner support beam (6*b*) of the framework (5), and passes through the apertures (24*a* & 24*b*) defined respectively by surrounding material in the framework and in the unit support casing.

Still referring to FIG. 4A, pivotable fasteners (11) and their attachment through (6*d*) and (7*a*) as well as (7*b*) and (6*c*) is visible.

FIG. 4B shows the upper half of the preferred embodiment of the invention with the table top in a second stored position with any upright wall (1C) removed just after the latching mechanism (22) has been activated by latch panel (25) being pulled outwardly, thereby rotating it about hinge (21) which is visible in FIGS. 2A 2B and 2C. In this detailed look at the latching mechanism, latching rod (23) is illustrated in phantom lines inside the second inner support beam (6*b*) of the framework (5), and has just been retracted therein, thereby disengaging latching rod (23) from apertures (24*a* & 24*b*). Once this disengagement has occurred, the movement of table top (2) to its use position as illustrated in the sequence of FIGS. 2A-2C can begin.

Figure 5A:
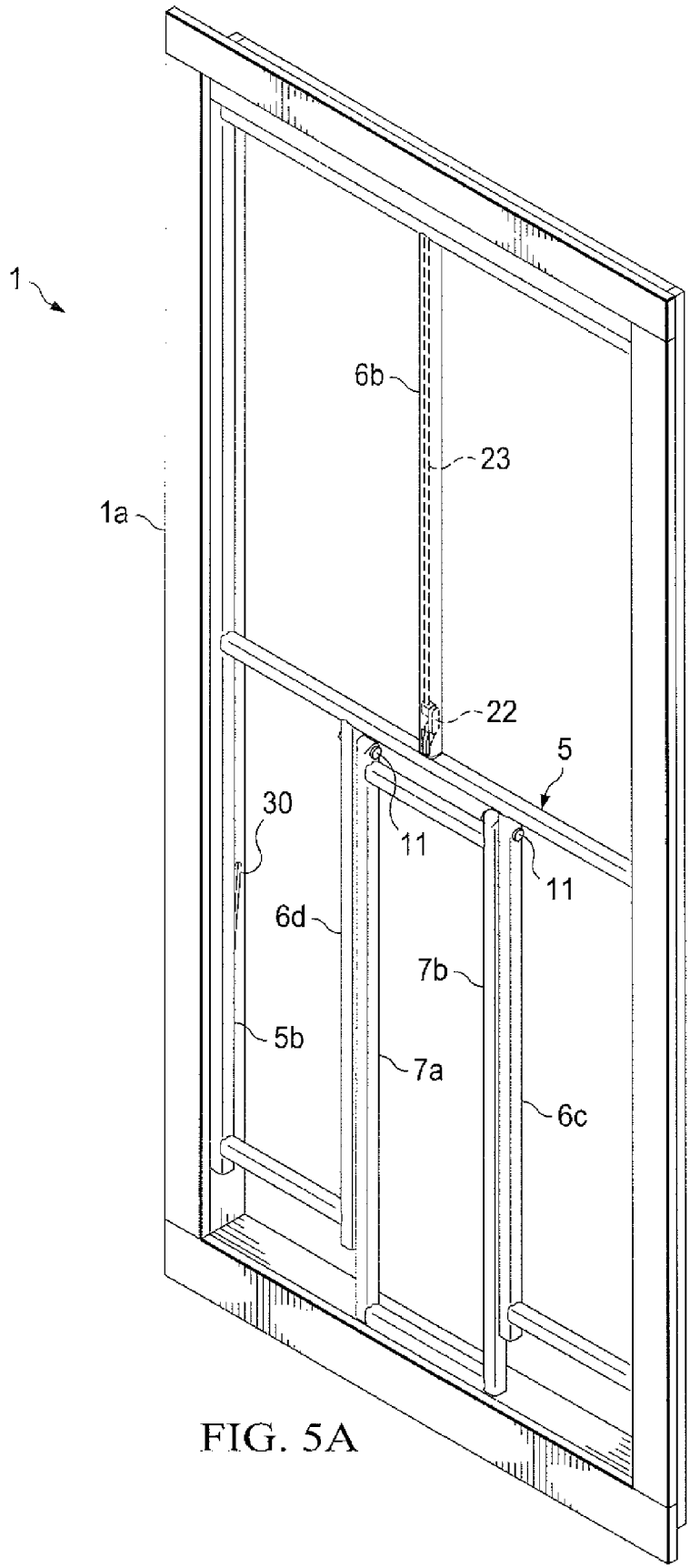
FIG. 5A is a perspective view of the invention according to FIG. 1 from the table top side closest to the viewer, with the table top removed to allow viewing of framework.

FIG. 5A shows the preferred embodiment of the invention in its second stored position (fully closed), uninstalled, from a perspective front view with e table top (2) removed in order to provide a full image of the framework (5) and inner mechanisms when the table assembly (1) is in its stored (undeployed) state. In this state, latching mechanism (22) is in its resting state, and latching rod (23) is engaged with apertures 24*a* and 24*b* which are not visible in this view, but which can be seen in FIGS. 4A and 4B. Second side frame portion (5*b*) can be seen, as can the top of roller guide slot (30). Not shown is roller (31) which in this state will be at the bottom end of roller guide slot (30). Pivotable fasteners (11) as they extend through from (6*d*) to (7*a*) and (6*c*) to (7*b*) can be seen.

Figure 5B:
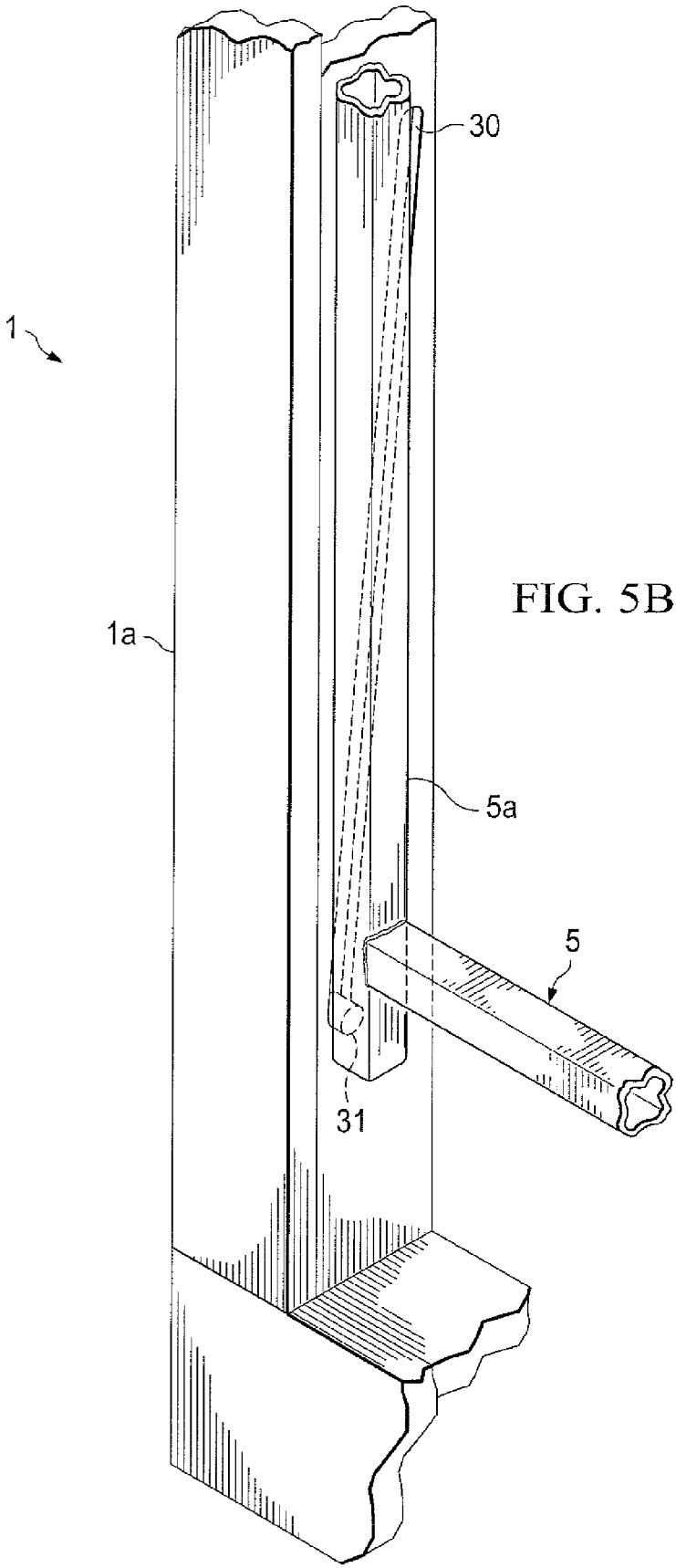
FIG. 5B is a partial perspective view of the roller system of the invention in its closed state from the same side as for FIG. 5A.

FIG. 5B is an enlarged view illustrating the interaction between the framework (5) and the roller guide slots (30) which are cut into the unit support casing (1A). The rollers (31) themselves are attached to the outer side edges of the framework (5*a* and 5*b*) and engage with the roller guide slots as seen in the FIG. 5B. FIG. 5B demonstrates this interaction while the table assembly is in its second stored position (closed state).

Figure 5C:
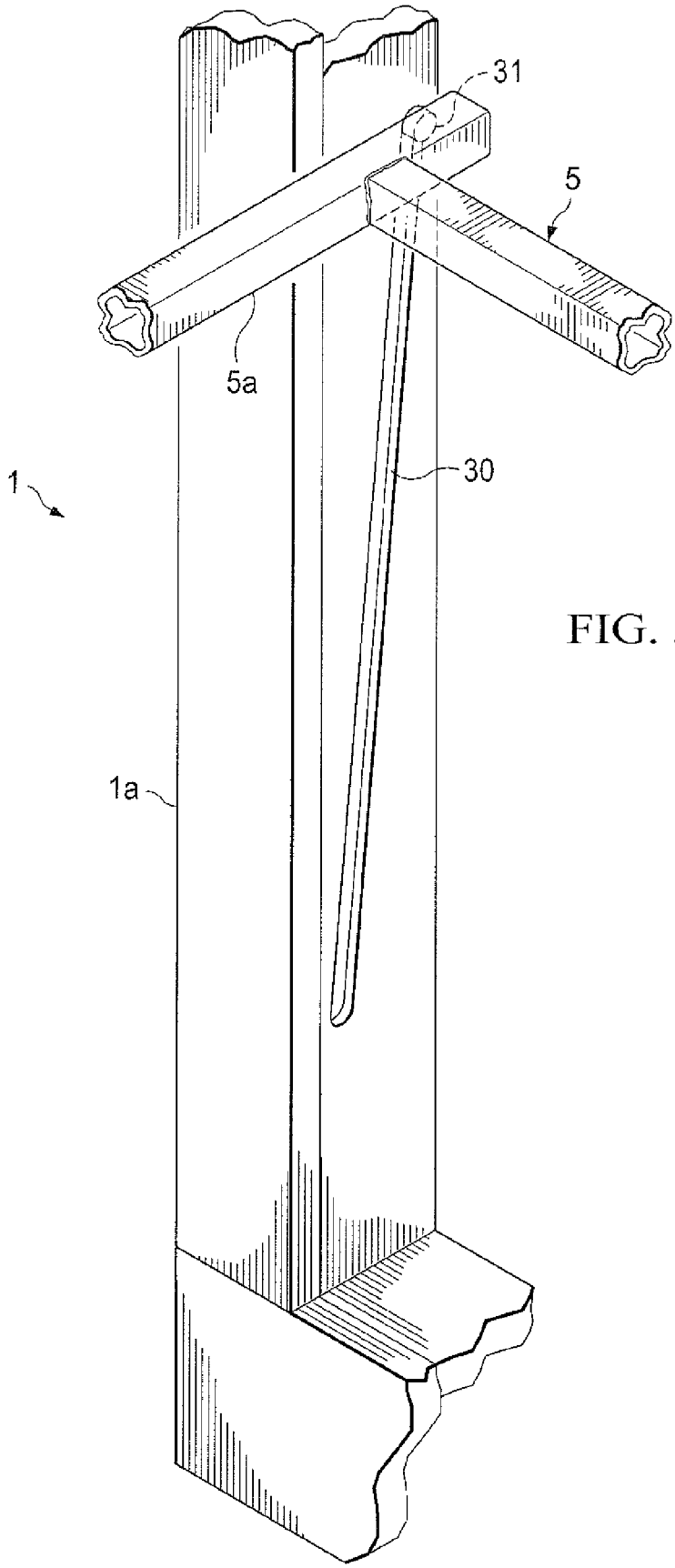
FIG. 5C is a partial perspective view of the roller system of the invention in its open state from the same side as for FIG. 5A

FIG. 5C is an enlarged view illustrating the interaction between the framework (5) and the roller guide slots (30) which are cut into the unit support casing (1A) when the table assembly has been fully deployed. The rollers (31) themselves are attached to outer side edges of the framework (5*a* and 5*b*) and engage with the roller guide slots (30) as seen in the illustration, Rollers (31) proceed to slide to the top of the roller guide slots during the process of table top (2) movement from its second stored position to its first use position, thus facilitating the movement of the table top.

FIG. 6 shows an alternate embodiment of the invention in its first use position (opened). In this embodiment, the supporting leg structure (3) is as wide as the table top (2), which provides for greater support and allows for increased variety of the outer facade of (3). The increased width may however decrease the legroom under the table assembly (1), but this may be acceptable to users depending on desired use. Consequentially, the supporting hinge (10), the pull hinge (21), and the latch panel (25) are also of the same width as the supporting leg structure, though the pull (20) itself may be unchanged or similar. The unit support casing (1A) is shown housing a series of shelves (40) for additional storage.

The preferred embodiment in FIGS. 1-5 may also be provided with inner storage shelves and the like, but using the other support leg width. Also visible are the apertures (24*a* & 24*b*) as defined by the material in the table top and in the unit support casing.

I claim:

1. A concealable table assembly, comprising:

(a) a table top having a generally rectangular outline, said table top comprising a table top surface and a table bottom surface, each of which have an outwardly facing side and an inwardly facing side, and four side surfaces each of which have an outwardly facing side and an inwardly facing side, said side surfaces connecting the table top surface to the table bottom surface, said table top having a first use position and a second stored position in said assembly;

(b) a unit support casing, said support casing comprising a top inner casing surface defining an aperture therein, two side inner casing surfaces and a bottom inner casing surface which together form a recessed area adapted to receive said table top in said second stored position;

(c) a framework serving as a skeletal support for said table top, said framework located between said table top surface and said table bottom surface adjacent said inwardly facing sides and adjacent said side surface inwardly facing sides, said framework comprising four edges and one or more inner support beams, said four edges consisting of a first, second and third edge which are essentially contiguous with three sides of said rectangular table top, and a fourth edge comprising a first fourth edge portion and a second fourth edge portion, each of said fourth edge portions having a side and an inner end, said side end of the first fourth edge portion is connected to said first edge of said framework and the side edge of the second fourth edge portion is connected to said second edge of said framework, and said inner ends of the first and second fourth edge portions are each connected to a different one of two inner support beams;

(d) a support leg having a support leg framework which is secured by pivotable fasteners to each of the two inner support beams that are attached to said first and second fourth edge portions, said support leg having outer surfaces comprising a front surface, a back surface, and four side surfaces attaching said front to said back surface, which outer surfaces form an enclosure for said support leg framework, said support leg having two long edges and a first bottom short edge and a second top short edge, said first bottom short edge secured to at least one hinge having a first attachment area and a second attachment area at said first attachment area; said second attachment area secured to said unit casing;

(e) a latching mechanism having a retractable rod which is engaged in the aperture defined by said top inner casing surface when said table top is in a second storage position and is unengaged therefrom when said table top is in its first use position, said latching mechanism located adjacent a portion of said framework, said latching mechanism having a latching means which may be activated by a user to move said rod from the engaged position to the unengaged position;

whereby, when said rod is retracted to said unengaged position, said table top may be tilted outwardly from vertical to horizontal as said pivotable fasteners attaching said support leg to said framework rotate counterclockwise, whereby the upper edge of the table top tilts downwardly and the lower edge of the table top tilts upwardly until the table top bottom has moved from a starting upright position to a position 90 degrees therefrom, whereby the top edge of said supporting leg may be engaged with an area on the bottom of said table top bottom surface and thereby provide support for said table top.

2. The table assembly of claim 1, wherein said area on the bottom of the table top is a slot-like feature defined by a latch panel, whereby said supporting leg top edge may be securely wedged into a slot formed when said latch panel is pulled out from the vertical plane of said table top bottom.

3. The table assembly of claim 1, wherein said unit support casing is two to fifteen inches deep.

4. The table assembly of claim 3, wherein said unit support casing is three to twelve inches deep.

5. The table assembly of claim 3, further comprising one or more shelves secured to said unit support casing.

6. The table assembly of claim 1, wherein said hinge is a heavy-duty hinge generally corresponding in length to the width of said bottom edge of said support leg.

7. The table assembly of claim 1, wherein more than one hinge is utilized to secure said support leg to said unit casing.

8. The table assembly of claim 1, wherein said table bottom surface comprises an aesthetic facade.

9. The table assembly of claim 8, wherein said support leg outer surface comprises a facade aesthetically complementary to said table bottom surface.

10. The table assembly of claim 1, further comprising a track defined by said side unit support casing and a roller attached to the side of the table top which engages with said track and may be rolled from a first position near the bottom of said unit casing to a second position upward therefrom, said rollers and tracks providing assistance in moving the bottom edge up to a 90 degree position.

11. The table assembly of claim 1, wherein said unit casing further comprises an upright back wall secured thereto.

12. The table assembly of claim 11, wherein said upright back wall further comprises an assisting trim piece secured thereto, said assisting trim positioned so to prevent said table top from continuing to move upwardly when it is in use position.

13. The table assembly of claim 1, wherein said table top is from about 60 to about 80 inches in length and long and from about 25 to 45 inches wide.

14. The table assembly of claim 1, wherein said table top is from about 65 to about 75 inches long and from about 25 to about 35 inches wide.

15. The table assembly of claim 1, wherein said table top is about 70 inches long and about 30 inches wide.

16. The table assembly of claim 1, wherein said support leg is approximately one-third the width of said table top.

17. The table assembly of claim 1, wherein said support leg is the same width as said table top.

18. The table assembly of claim 1, wherein said support leg is attached to said unit casing by one hinge.

19. The table assembly of claim 18, wherein said hinge is at least about 10 inches in length.

20. The table assembly of claim 1, wherein said support leg is attached to said unit casing by two hinges having a length of from about five inches to from about fifteen inches.

* * * * *

UNITED STATES PATENT AND TRADEMARK OFFICE

CERTIFICATE OF CORRECTION

PATENT NO. : 7,735,428 B2
APPLICATION NO. : 11/943838
DATED : June 15, 2010
INVENTOR(S) : Michael Carl Petty It is certified that error appears in the above-identified patent and that said Letters Patent is hereby corrected as shown below:

Col. 1, line 25, after "position" add -- ; --
Col. 1, line 30, after "position" add -- ; --
Col. 1, line 54, after "FIG. 5A" add -- ; and --
Col. 2, line 39, replace "each each" with -- each --
Col. 7, line 24, replace "(Ed)" with -- (5d) --
Col. 8, line 21, remove "e" between "with" and "table"
Col. 8, line 47, replace "," after "illustration" with -- . --

Signed and Sealed this

Twenty-third Day of November, 2010

David J. Kappos

David J. Kappos
*Director of the United States Patent and Trademark Office*